US006446726B1

(12) United States Patent
Grundmann

(10) Patent No.: US 6,446,726 B1
(45) **Date of Patent: *Sep. 10, 2002**

(54) WELLBORE AND FORMATION HEATING SYSTEM AND METHOD

(75) Inventor: Steven R. Grundmann, Duncan, OK (US)

(73) Assignee: Halliburton Energy Services, Inc., Duncan, OK (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/522,430

(22) Filed: Mar. 9, 2000

(51) Int. Cl.[7] ..... E21B 43/12; E21B 43/00
(52) U.S. Cl. ..... 166/288; 166/302
(58) Field of Search ..... 166/288, 281, 166/276, 299, 302

(56) References Cited

U.S. PATENT DOCUMENTS

| | | | | | |
|---|---|---|---|---|---|
| 3,171,480 | A | | 3/1965 | Carter | 166/25 |
| 3,205,946 | A | * | 9/1965 | Prats et al. | 166/288 |
| 3,275,077 | A | * | 9/1966 | Smith et al. | 166/288 |
| 3,373,812 | A | * | 3/1968 | Smith | 166/288 |
| 3,406,756 | A | | 10/1968 | Carter et al. | 166/21 |
| 3,559,736 | A | * | 2/1971 | Bombardieri | 166/276 |
| 3,709,298 | A | * | 1/1973 | Pramann | 166/276 |
| 3,768,566 | A | | 10/1973 | Ely et al. | 166/308 |
| 3,871,455 | A | * | 3/1975 | Hardy et al. | 166/288 |
| 3,973,627 | A | * | 8/1976 | Hardy et al. | 166/276 |
| 4,077,469 | A | * | 3/1978 | Hamrick et al. | 166/59 |
| 4,118,925 | A | * | 10/1978 | Sperry | 60/39.05 |
| 4,210,206 | A | | 7/1980 | Ely et al. | 166/294 |
| 4,463,803 | A | * | 8/1984 | Wyatt | 166/59 |
| 4,470,459 | A | | 9/1984 | Copland | 166/248 |
| 5,159,980 | A | | 11/1992 | Onan et al. | 166/294 |
| 5,211,234 | A | | 5/1993 | Floyd | 166/276 |
| 5,293,938 | A | | 3/1994 | Onan et al. | 166/293 |

* cited by examiner

*Primary Examiner*—Hoang Dang
(74) *Attorney, Agent, or Firm*—John W. Wustenberg; Robert A. Kent; Neal R. Kennedy

(57) ABSTRACT

An apparatus and method for wellbore and formation heating. In the method, after perforation of the well, fracturing material is pumped into the perforations to fracture the formation. This fracturing material comprises a mixture of sand and thermosetting plastic. Heat is subsequently applied to the formation and thereby to the plastic to cause the plastic to set so that flow-back of the plastic and sand is prevented while still allowing fluid flow from the formation through the sand into the well casing. The heating apparatus comprises a dual tubing string with a burner chamber attached to the lower end thereof The outer tubing of the dual tubing string is adapted for connection to an oxygen source, and the inner tubing string is adapted for connection to a fuel source. The apparatus also comprises an ignition source for providing a spark to ignite the fuel and oxygen mixture. The ignition source may be a mechanical device such as a grinding wheel rotating against a ferrous element, or an electrical device, such as a spark plug.

20 Claims, 1 Drawing Sheet

WELLBORE AND FORMATION HEATING SYSTEM AND METHOD

BACKGROUND OF THE INVENTION

1. Field of the Invention

This invention relates to screenless completion systems in wellbores, and more particularly, to an apparatus and method using a thermosetting plastic mixed with sand which is pumped into a well formation and setting the plastic by applying heat thereto.

2. Description of the Prior Art

As part of the completion of a well after perforating a well formation, fracturing materials are typically pumped into the well and forced into the fracture formation. A common material used in fracturing is sand or another similar material. A problem exists in maintaining the sand in the fractured formation so that it does not flow out with the formation fluid. Accordingly, there have been developed many techniques for holding the sand and preventing this flow-back problem.

One common way to hold in the sand is to install a sand screen in the wellbore adjacent to the formation. Such a sand screen will allow fluid flow from the well formation but will physically keep the sand in place. Of course, this requires special equipment installed in the wellbore and therefore there is additional expense involved.

In many well formations, a mechanical screen is unnecessary or impractical. In such cases, special materials are pumped into the well with the sand during the fracturing process or after the pumping of the sand which subsequently hold the sand in place. For example, a gel material may be mixed with the sand such that the gel subsequently sets, after fracturing the formation, to form a solid gel containing sand in the fractured formation. This essentially bonds the sand together so that it will not flow back out of the formation but will still allow the flow of formation fluid therethrough. The setting of the gel may be accomplished by mixing a self-setting gel so that it sets after a certain period of time, or a setting chemical may be subsequently pumped down the wellbore which causes the gel to set.

In some cases, however, a self-setting gel is undesirable because the operator may not know in advance the time at which it will be desirable for the gel to set. Also, it may be impractical or undesirable to use a separate chemical pumped down the wellbore. The present invention solves these problems by providing a method of screenless well completion which utilizes a thermosetting plastic mixed with the sand. When the sand and plastic are pumped down into the formation to fracture it, the plastic remains in a substantially liquid state. At the time at which the operator wishes to set the plastic, a downhole heater is run into the well which applies heat adjacent to the formation above the setting temperature of the thermosetting plastic. The heating apparatus of the present invention may be used in this method.

SUMMARY OF THE INVENTION

The present invention includes a screenless completion system for wells which utilizes a thermosetting plastic material mixed with sand for fracturing a formation and then subsequently applying heat thereto. More specifically, the method comprises the steps of pumping a mixture of sand and thermosetting plastic material into a perforated formation, and applying heat to the formation, thereby setting the plastic so that the plastic and sand are prevented from flowing back into the well. The step of applying heat comprises pumping fuel and oxygen down the well, mixing the fuel and oxygen to form a combustible mixture, and igniting the mixture so that hot combustion gases are forced into the formation. The heater of this invention is used to apply this heat.

The oxygen will generally be provided simply by pumping air down the tool string to the heater. The supply of this air may be ambient air at the surface or air from a pressurized air tank. The fuel is pumped from a fuel tank into the tool string to the heater. A preferred fuel is a liquefied petroleum gas, such as propane, but the invention is not intended to be limited to this alone.

The method may further comprise pumping an inert gas down the well to dampen the heat for preventing damage to a casing surface adjacent to the heater. Preferably, but not by way of limitation, the inert gas is pumped through a well annulus defined between the heater and the casing. The combustion gases are mixed with the insert gas so that the hot combustion gases and heated inert gas are forced into the formation together.

One preferred inert gas is nitrogen, but other non-combustible gases could also be used. For many thermosetting plastics, the inert gas is used so that approximately 600° F. is actually applied to the plastic material. This temperature is sufficient to cause setting of the plastic while preventing damage thereto.

The heating apparatus of the present invention is adapted for applying heat in a well and comprises a length of dual string coiled tubing having a length of first or outer tubing and a length of relatively smaller second or inner tubing disposed in the outer tubing such that a tubing annulus is defined there between, and a burner chamber in communication with said inner and outer tubing. When fuel is pumped down one of the inner and outer tubing, and oxygen is pumped down the other of the inner and outer tubing, a fuel and oxygen mixture is formed in the burner chamber. The apparatus further comprises ignition means for igniting the mixture.

Preferably, the outer tubing is adapted for connection to an oxygen supply, and the inner tubing is adapted for connection to a fuel supply. A fuel nozzle may be provided in communication with the inner tubing. The combustion chamber preferably comprises a ceramic cylinder defining a plurality of holes therein.

In one embodiment, the ignition means is mechanical and comprises a ferrous element disposed in the burner chamber, a grinder in contact with the ferrous element, and means for moving the grinder against the ferrous element for generating a spark. In one specifically preferred embodiment, the grinder is a grinding wheel attached to a rotatable shaft of a motor, and the motor is characterized by a progressive cavity motor connected to the shaft and thereby rotating the grinding wheel when a fluid is pumped through the motor. The fluid through the motor may be the fuel which is pumped down the inner tubing string.

In another embodiment, the ignition means is electronic. For example, a spark plug may be positioned adjacent to the burner chamber and power provided therethrough from a wire to the surface or other means of providing an electrical connection so that a spark is generated. Thus, the step of igniting in the previously described method may comprise creating a spark by rotating a grinding wheel against a ferrous element adjacent to the fuel and oxygen mixture or by providing electrical power to a spark plug adjacent to the mixture.

Numerous objects and advantages of the invention will become apparent as the following detailed description of the preferred embodiments is read in conjunction with the drawings which illustrate such embodiments.

DESCRIPTION OF THE PREFERRED EMBODIMENTS

Figure 1:
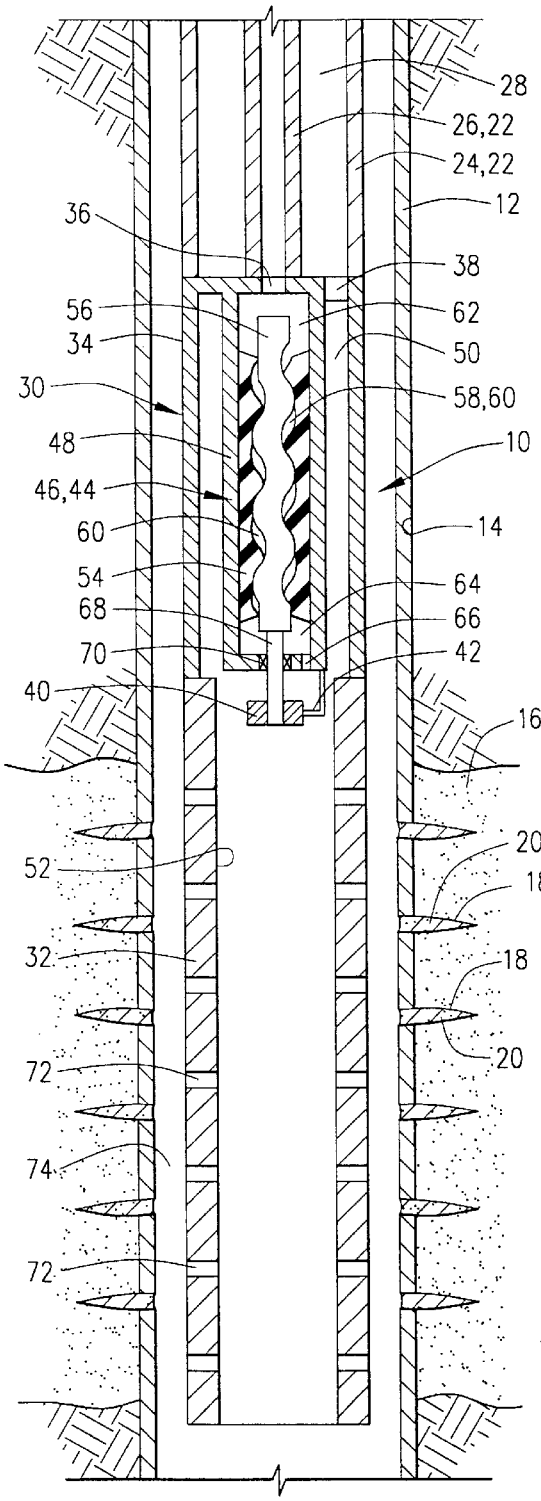
FIG. 1 illustrates a first embodiment of the wellbore and formation heating system of the present invention which includes mechanical ignition.

Referring now to the drawings, and more particularly to FIG. 1, a first embodiment of the wellbore and formation heating system of the present invention is shown and generally designated by the numeral 10. Apparatus 10 is shown disposed in a well casing 12 of a wellbore 14 which has a formation or zone of interest 16. FIG. 1 shows casing 12 in formation 16 after the formation has been perforated and thus has a plurality of perforations 18 illustrated. FIG. 1 also shows perforations 18 with a fracturing material 20 therein. Fracturing material 20 comprises a mixture of sand and a thermosetting plastic.

In order to set the plastic, heat must be applied thereto which will fuse the plastic material and thus hold fracturing material 20 in perforations 18. This allows fluid flow from formation 16 into well casing 12 while preventing flow-back of the sand and plastic.

Apparatus 10 is a heater which provides sufficient heat to raise the temperature of the thermosetting plastic to at least its setting temperature.

Apparatus 10 comprises a dual tubing string 22 such as dual coiled tubing string, having a first or outer tubing string 24 and a relatively smaller second or inner tubing string 26 disposed therein. A tubing annulus 28 is defined between outer tubing 24 and inner tubing 26.

Disposed below outer tubing 24 and inner tubing 26 is an ignition means 30, and below the ignition means is a burner chamber 32. FIG. 1 illustrates ignition means 30 as a mechanical ignition means 30.

Ignition means 30 comprises a housing 34 which is connected at its upper end to outer tubing string 24 and inner tubing string 26 and is connected at its lower end to the top of burner chamber 32. The upper end of housing 34 has a fuel port 36 therein in communication with inner tubing 26 and at least one oxygen port 38 in communication with tubing annulus 28.

Ignition means 30 further comprises a grinding wheel 40 engaging a ferrous element 42 and a rotating means 44 for rotating grinding wheel 40 against ferrous element 42.

241 In the illustrated embodiment, rotating means 44 is shown as a progressive cavity or "Moyno" motor 46. It should be understood that other means for rotating grinding wheel 40 could also be used, however. For example, but not by way of limitation, a turbine motor or electric motor could be used instead of progressive cavity motor 46.

Motor 46 includes a motor case 48 disposed in housing 34 such that a housing annulus 50 is defined there between. It will be seen that housing annulus 50 is in communication with oxygen ports 38 and therefore in communication with tubing annulus 28. Housing annulus 50 is also in communication with a central opening 52 in burner chamber 32.

Ferrous element 42 is shown attached to the lower end of motor case 48, but it should be understood that the invention is not limited to such a configuration. For example, ferrous element 42 could be attached to the inside of housing 34 or burner chamber 32.

In the illustrated progressive cavity embodiment of motor 46, the motor comprises an elastomeric stator 54 disposed in case 48 and a rotor 56 generally centrally located within stator 54 and coaxial therewith. A pumping chamber 58 is defined between stator 54 and rotor 56. The inner surface of stator 54 is corrugated, and the outer surface of rotor 56 has a rounded, substantially helical screw-type threaded surface so that pumping chamber 58 defines a plurality of cavities 60 spaced along the length of the pumping chamber.

Case 48 has an inlet 62 at the upper end thereof which is in communication with fuel port 36 and thus in communication with inner tubing 26. Inlet 62 is thus seen to be above stator 54 and rotor 56. Below stator 54 and rotor 56, case 48 defines an outlet 64 therein. A fuel nozzle or port 66 at the lower end of case 48 is in communication with outlet 64 and allows the flow of fuel from the outlet into burner chamber 32, as will be further described herein.

A shaft 68 extends from the lower end of rotor 56 through the lower end of case 48. Grinding wheel 40 is mounted on shaft 68. A seal 70 provides sealing between shaft 68 and case 48.

Burner chamber 32 is preferably made of a ceramic material to withstand the heat therein. Burner chamber 32 defines a plurality of transversely extending openings 72 therein which provide communication between central opening 52 in the burner chamber and a well annulus 74 defined between heating apparatus 10 and casing 12.

In the operation of first embodiment apparatus 10, the apparatus is positioned adjacent to perforations 18 in formation 16 and casing 12 as shown in FIG. 1. Fuel is then pumped down inner tubing 26, through fuel port 36 into pump inlet 62. Fuel is forced into pumping chamber 58 so that rotor 56 is rotated within stator 54. The rotation of rotor 56 rotates shaft 70 and thus grinding wheel 40 which rotates against ferrous element 42, thereby generating a spark in burner chamber 32. It will thus be seen that fuel discharged from fuel nozzle 66 is near this spark.

Substantially simultaneously with pumping fuel down inner tubing 26, oxygen, usually provided by pumping air, is pumped down tubing annulus 28, through oxygen ports 38 into housing annulus 50, and finally into burner chamber 32. Those skilled in the art will see that a fuel and oxygen mixture is thus formed in burner chamber 32 which will be ignited by the spark caused by the rotation of grinding wheel 40 against ferrous element 42. This combustion, of course, generates heat within burner chamber 32 which is thus applied to the thermosetting plastic in fracturing material 20 so that the thermosetting material is set as desired.

The fuel in the preferred embodiment is propane, a liquefied petroleum gas, which burns with the oxygen in the air supplied thereto at approximately 2800° F. The ceramic material of burner chamber 32 can withstand such a temperature, but in most well configurations, the combustion process alone would supply too much heat to casing 12 and fracturing material 20. This heat could destroy the plastic in fracturing material 20 and could melt the steel in casing 12. In order to prevent this, an inert gas, such as nitrogen, is pumped down well annulus 74 to abate the heat. The expanding hot gases from the combustion process within burner chamber 32 are discharged through transverse openings 72 and mixed with the inert gas. The inert gas dampens the heat considerably and thereby prevents damage to casing 12 and the plastic in formation material The combustion gases and inert gas are thus flowed into formation 16, applying thereto and causing the plastic to set.

By controlling the amount of nitrogen, fuel and oxygen, the temperature applied to the thermosetting plastic can be held to a preferred temperature of about 600° F. which is sufficient to fuse most thermosetting plastics while preventing damage thereto. Such temperatures are also easily resisted by casing 12.

Figure 2:
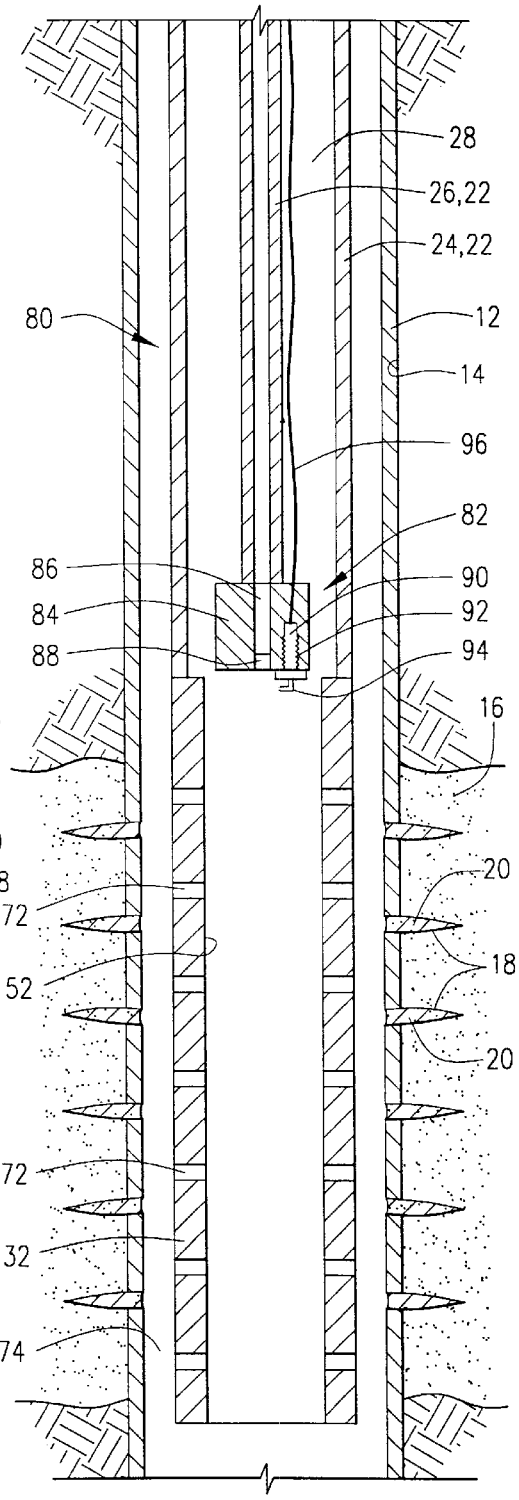
FIG. 2 shows a second embodiment of the apparatus with electrical ignition.

Referring now to FIG. 2, the second embodiment of the wellbore and formation heating system of the present invention is shown and generally designated by the numeral 80. Apparatus 80 is also illustrated positioned in a well casing 12 of a wellbore 14 having a formation 16 therein. Formation 16 and casing 12 are shown with perforations 18 therein filled with a fracturing material 20.

The second embodiment apparatus 80, just as first embodiment 10, comprises a dual tubing string 22 having an outer tubing string 24 and an inner tubing string 26. Apparatus 80 also comprises a burner chamber 32, similar or identical to that of the first embodiment, and an ignition means 82. In this embodiment, burner chamber 32 is directly connected to the lower end of outer tubing 24, and ignition means 82 is connected to the lower end of inner tubing 26, so that the ignition means is adjacent to the upper end of burner chamber 32.

Ignition means 82 is an electric ignition means 82 and comprises a housing 84 attached to inner tubing 26 and defining a fuel port 86 therethrough which is in communication with the inner tubing. A fuel nozzle 88 may be positioned at the lower end of fuel port 86.

A spark plug 90 is disposed in housing 84 and attached thereto by threaded connection 92. Spark plug 90 is a conventional plug with an electrode or tip 94 on the end thereof Electrical power is supplied to spark plug 90 by a wire 96 which extends to the surface. Any other means of providing electrical power to a downhole tool could also be used.

The operation of second embodiment apparatus 80 is very similar to that of first embodiment 10. Once formation 16 has been fractured, apparatus 80 is positioned adjacent to the formation as shown in FIG. 2. Fuel is pumped down inner tubing 26, through fuel port 86 in housing 84 and discharged out fuel nozzle 88 into burner chamber 32. Substantially simultaneously, oxygen, again generally contained in air, is pumped down tubing annulus 28 into burner chamber 32 so that a combustible mixture of fuel and oxygen is created.

By providing electrical power through wire 96 to spark plug 90, a spark is generated by electrode 94 which ignites the fuel and oxygen mixture. The heat is supplied to the thermosetting plastic in fracturing material 20 by the expanding gases from the combustion process, just as in the first embodiment. Also as in the first embodiment, an inert gas, such as nitrogen, may be pumped down well annulus 74 to mix with the combustion gases and dampen the heat, as previously described.

It will be seen, therefore, that the wellbore and formation heating system of the present invention, and the method of use thereof are well adapted to carry out the ends and advantages mentioned as well as those inherent therein. While presently preferred embodiments of the apparatus and method have been shown for the purposes of this disclosure, numerous changes in the arrangement and construction of parts in the apparatus and in the steps of the method may be made by those skilled in the art. All such changes are encompassed within the scope and spirit of the appended claims.

What is claimed is:

1. A method of completing a well comprising the steps of:

(a) pumping a mixture of sand and a substantially liquid thermosetting plastic material into a perforated formation; and (b) applying heat to the formation above the setting temperature of the thermosetting plastic, thereby solidifying the plastic so that the plastic and sand are prevented from flowing back into the well.

2. The method of claim 1 wherein step (b) comprises:

pumping fuel and oxygen down the well;

mixing the fuel and oxygen to form a combustible mixture; and igniting the mixture so that hot combustion gases are forced into the formation.

3. The method of claim 2 wherein said step of igniting comprises creating a spark in a heater by providing electrical power to a spark plug adjacent to said mixture.

4. The method of claim 2 wherein said step of pumping fuel comprises pumping a liquefied petroleum gas.

5. The method of claim 2 wherein said step of pumping oxygen comprises pumping air.

6. The method of claim 1 wherein, in step (b), the heat is applied such that the temperature of the plastic material is raised to at least approximately 600° F.

7. A method of completing a well comprising the steps of:

(a) pumping a mixture of sand and thermosetting plastic material into a perforated formation; and (b) applying heat to the formation, thereby setting the plastic so that the plastic and sand are prevented from flowing back into the well, step (b) comprising:

pumping fuel and oxygen down the well;

mixing the fuel and oxygen to form a combustible mixture; and igniting the mixture by creating a spark in a heater by rotating a grinding wheel against a ferrous element adjacent to said mixture so that hot combustible gases are forced into the formation.

8. The method of claim 7 wherein said step of rotating comprises providing said grinding wheel attached to a rotatable shaft of a motor.

9. The method of claim 8 wherein:

said motor is a progressive cavity motor; and said step of rotating further comprises pumping a fluid through said motor and thereby rotating a rotor connected to said shaft and thereby rotating said grinding wheel.

10. The method of claim 9 wherein said fluid is the fuel.

11. A method of completing a well comprising the steps of:

(a) pumping a mixture of sand and thermosetting plastic material into a perforated formation; and (b) applying heat to the formation, thereby setting the plastic so that the plastic and sand are prevented from flowing back into the well, step (b) comprising:

pumping fuel and oxygen down the well;

mixing the fuel and oxygen to form a combustible mixture;

igniting the mixture in a heater so that hot combustion gases are forced into the formation; and pumping an inert gas down the well to dampen said heat and thereby preventing damage to a casing surface adjacent to said heater.

12. The method of claim 11 wherein said step of pumping said inert gas comprises pumping said inert gas through a well annulus defined between said heater and said casing.

13. The method of claim 12 wherein the combustion gases are mixed with the inert gas so that the combustion gases and heated inert gas are forced into the formation together.

14. The method of claim 11 wherein the step of pumping an inert gas comprises pumping nitrogen.

15. A method of completing a well comprising the steps of:

(a) pumping a mixture of sand and thermosetting plastic material into a perforated formation; and (b) thermosetting the thermosetting plastic by applying heat to the formation so that the plastic and sand are prevented from flowing back into the well.

16. The method of claim 15 wherein step (b) comprises:

pumping fuel and oxygen down the well;

mixing the fuel and oxygen to form a combustible mixture; and igniting the mixture so that hot combustion gases are forced into the formation.

17. The method of claim 16 wherein said step of igniting comprises creating a spark in a heater by rotating a grinding wheel against a ferrous element adjacent to said mixture.

18. The method of claim 16 wherein said step of igniting comprises creating a spark in a heater by providing electrical power to a spark plug adjacent to said mixture.

19. The method of claim 16 further comprising pumping an inert gas down the well to dampen said heat and thereby preventing damage to a casing surface adjacent to said heater.

20. The method of claim 19 wherein the combustion gases are mixed with the inert gas so that the combustion gases and heated inert gas are forced into the formation together.

* * * * *